US006697585B2

(12) United States Patent
Dougherty et al.

(10) Patent No.: US 6,697,585 B2
(45) Date of Patent: Feb. 24, 2004

(54) SYSTEM FOR AND METHOD OF REDUCING OR ELIMINATING LEAKAGE WITH A VIBRATING SEAL

(75) Inventors: Patrick S. Dougherty, Boise, ID (US); Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/103,371

(22) Filed: Mar. 21, 2002

(65) Prior Publication Data

US 2003/0180068 A1 Sep. 25, 2003

(51) Int. Cl.[7] ..... G03G 15/08
(52) U.S. Cl. ..... 399/103
(58) Field of Search ..... 399/102, 103, 399/105

(56) References Cited

U.S. PATENT DOCUMENTS

| | | | | |
|---|---|---|---|---|
| 5,757,395 A | | 5/1998 | Chew et al. | 347/24 |
| 5,760,817 A | | 6/1998 | Foote et al. | 347/248 |
| 5,854,961 A | | 12/1998 | Wibbels et al. | 399/281 |
| 6,496,669 B2 | * | 12/2002 | Sato et al. | 399/103 |
| 6,549,735 B2 | * | 4/2003 | Fujita et al. | 399/103 |

OTHER PUBLICATIONS

"Oasis–Tech's Tool Box– Laser Printing Process" [on–line] [Retrieved on Nov. 26, 2001]Retrieved from: http://www.oasis–imaging.com/tech/related.html, pp. 1–4.

"The PC Technology Guide– Laser Printers" [on–line][Retrieved on Nov. 26, 2001] Retrieved from: http://www.pctechguide.com/12lasers.htm, pp. 1–8.

* cited by examiner

*Primary Examiner*—William J. Royer

(57) ABSTRACT

The present invention includes a sealing mechanism for use in a cartridge having a roller having an undulant annular channel and a flexible seal having a follower where the follower is configured to engage the undulant annular channel. Rotation of the roller induces a laterally reciprocating motion of the flexible seal with respect to the roller. Another embodiment of the present invention includes a method of reducing toner leakage in a cartridge comprising the steps of engaging a follower of a flexible seal within an undulant annular channel formed in a roller and rotating the roller to induce a laterally reciprocating motion in the flexible seal. When toner is applied to the roller in the vicinity of the flexible seal, the laterally reciprocating motion of the flexible seal sweeps toner in a direction away from the undulant annular channel.

20 Claims, 2 Drawing Sheets

SYSTEM FOR AND METHOD OF REDUCING OR ELIMINATING LEAKAGE WITH A VIBRATING SEAL

RELATED APPLICATIONS

The present application is related to commonly assigned U.S. patent application Ser. No. 10/103,208 entitled "A SYSTEM FOR AND METHOD OF REDUCING TONER SEAL LEAKAGE BY THE INTRODUCTION OF A STEP GROOVE IN THE DEVELOPER ROLLER;" U.S. patent application Ser. No. 10/103,430 entitled "SYSTEM FOR AND METHOD OF PREVENTING TONER LEAKAGE PAST DEVELOPER SEALS USING STATIC CHARGE;" U.S. patent application Ser. 10/103,451 entitled "SYSTEM FOR AND METHOD OF TONER FLOW CONTROL;" and U.S. patent application Ser. No. 10/103,208 entitled "METHOD OF AND SYSTEM FOR THE REDUCTION OF TONER PRESSURE APPLIED TO A PRINT SEAL THROUGH THE IMPLEMENTATION OF A TAPERING CHANNEL", all filed concurrently herewith, the disclosures of which are all hereby incorporated by reference in their entirety.

TECHNICAL FIELD

The present invention generally relates to electrophotographic printing devices and more specifically to the reduction of toner leakage through seals in these devices.

BACKGROUND

Currently there are several types of technologies used in printing and copying systems. Electrophotographic printing devices such as laser printers and copiers use toner particles to form the desired image on the a print medium, which is usually some type of paper. While the toner particles are solid, their small size (on the order of 3–15 microns) results in highly fluid properties. Once the toner particles are is applied to the paper, the paper is advanced along the a paper path to a fuser. In many printers, copiers and other electrophotographic printing devices, the fuser includes a heated fusing roller engaged by a mating pressure roller. As the paper passes between the rollers, toner particles are is fused to the paper through a process of heat and pressure.

FIG. 1 is a diagram of typical laser printing device 100 employing an electrophotography (EP) process. For monochromatic printing, a single color of toner particles 101 are held in toner supply hopper 102. Toner particles 101 are typically small plastic (e.g. styrene) particles on the order of 5 microns (10–6) meter in size. Agitator, or stirring blade, 103 is typically made of plastic or mylar and ensures toner particles 101 are uniformly positioned along developer sleeve 104 while inducing a negative charge onto the toner particles 101 in the range of −30 to −40 micro coulomb per gram ($\mu$C/g). Developer sleeve 104 rotates in a counterclockwise direction about an internal stationary magnet 105 which acts as a shaft. Toner particles 101 are attracted to the rotating developer sleeve 104 by the magnetic forces of stationary magnet 105. Doctor blade 106 helps in charging toner particles 101 and metes out a precise and uniform amount of toner particles 101 onto developer sleeve 104 as its outer surface rotates external to toner supply hopper 102. Developer sealing blade 107 removes excess toner particles 101 affixed to developer sleeve 104 as its outer surface rotates back into toner supply hopper 102.

Primary Charging Roller (PRC) 108 conditions Organic Photo Conductor (OPC) drum 109 using a constant flow of current to produce a blanket of uniform negative charge on the surface of OPC drum 109. Production of the uniform charge also has the effect of erasing residual charges left from the previous cycle.

A central component of the EP process is OPC drum 109. OPC drum 109 is a thin-walled aluminum cylinder coated with a photoconductive layer. The photoconductive layer may constitute a photodiode that accepts and holds a charge from PRC 108. Initially, the unexposed surface of the OPC drum 109 is charged to a potential of approximately −600 volts. Typically, the photoconductive layer comprises three layers including, from the outermost inward, a Charge Transport Layer (CTL), Charge Generation Layer (CGL), and barrier or oxidizing layer formed on the underlying aluminum substrate. The CTL is a clear layer approximately 20 microns thick, which allows light to pass through to the CGL and controls charge acceptance to the OPC drum 109. The CGL is about 0.1 to 1 micron thick and allows the flow of ions. The barrier layer bonds the photoconductive layer to the aluminum substrate.

Laser beam 110 exposes OPC drum 109 one scan line at a time at the precise locations that will receive toner particles 101 (paper locations which correspond to the image being printed). OPC drum 109 is discharged from −600 V to approximately −100 V at points of exposure to laser beam 110, creating a relatively positively charged latent image on its surface. Transformation of the latent image into a developed image begins when toner particles 101 are magnetically attracted to rotating developer sleeve 104. Alternatively, if nonmagnetic toner is used, developer sleeve 104 may comprise a foam roller to mechanically capture toner particles 101. In this case, an open cell foam roller may be included to apply toner particles 101 to developer sleeve 104. The still negatively charged toner particles 101 held by developer sleeve 104 is are attracted to the relatively positively charged (i.e., less negatively charged) areas of the surface of OPC drum 109 and "jumps" across a small gap to the relatively positively charged latent image on OPC drum 109 creating a developed image.

Paper to receive the developed image from OPC drum 109 is transported along paper path 111 between OPC drum 109 and transfer roller 112, with the toner particles 101 forming the developed image are transferred from the surface of OPC drum 109 to the paper. The transfer occurs by action of transfer roller 112 which applies a positive charge to the underside of the paper, attracting the negatively-charged toner particles 101 to move to the paper. Wiper blade 113 cleans the surface of the OPC drum 109 by scraping off the waste (untransferred) toner particles 101 into waste hopper 115, while recovery blade 114 prevents the waste toner particles from falling back onto the paper. Fusing occurs as the paper, including transferred toner particles 101 is passed through a nip region between heated roller 116 and pressure roller 117 where the toner particles 101 is are melted and fused (or "bonded") to the paper. Heated roller 116 and pressure roller 117 as a unit are referred to as the fuser assembly.

One design consideration with electrophotographic imaging devices such as laser printers and copying systems is the need to minimize the leakage of toner or toner particles 101 from toner supply hopper 102. As shown in FIG. 2, in its normal position, developer sleeve 104 has an enclosed toner supply on one side of the seal 201 and is open to the internal structure of the toner cartridge on the other side of the seal 201. Seals 201 in this area are incorporated in an attempt to reduce or eliminate toner leakage from toner supply hopper 102.

In addition to leakage along the a roller, leakage sometimes occurs at the ends of developer sleeve 104 (FIG. 1). Several methodologies have been used to reduce or eliminate such leakage. For example, i.e., some printers employ a foam or felt mechanical seal at the ends of developer sleeve 104 as a physical barrier to prevent toner particles 101 from leaking past the end of developer sleeve 104 and out of toner supply hopper 102. Alternatively, when the toner includes magnetic particles, such as in some black and white toners, magnetic seals may be provided at the ends of developer sleeve 104 to attract and capture toner particles 101 and create a physical barrier, consisting of the toner particles 101, to prevent additional toner particles 101 from leaking.

FIG. 2 shows another view of the configuration of developer sleeve 104, toner buildup 203 and seal 201. As shown, seal 201 is positioned between support 202 and developer sleeve 104. Support 203 may be semicircular regions formed in the sidewalls of toner supply hopper 102 allowing a rear portion of developer sleeve 104 to intrude into the toner supply hopper 102 to receive toner particles 101 while an exposed frontal portion of the developer sleeve 104 provides toner particles 101 to the OPC drum 109 as previously described. Because of the fluidity of the toner particles 101, as developer sleeve 104 rotates, toner particles 101 are forced into the region whereat seal 201 contacts developer sleeve 104. This action causes toner buildup 202 and corresponding increased toner fluid pressure in the contact region causing the toner particles 101 to leak under, around and through seal 201.

Accordingly, a need exists for a system and a method for reducing toner leakage in a toner cartridge.

SUMMARY OF THE INVENTION

The present invention is directed to a sealing mechanism for use in a toner cartridge comprising a developer roller having an undulant annular channel and a flexible seal having a follower configured to engage the undulant annular channel. The flexible seal is configured such that rotation of the developer roller induces a laterally reciprocating motion of the flexible seal with respect to the developer roller. Another embodiment of the present invention is directed to a method of reducing toner leakage in a toner cartridge by engaging a follower with a the first flexible seal within an undulant annular channel formed in the developer roller, rotating the developer roller thereby inducing a laterally reciprocating motion in a first flexible seal and applying toner to the developer roller in a vicinity of the first flexible seal whereby the laterally reciprocating motion of the first flexible seal sweeps the toner in a direction away from the undulant annular channel.

DETAILED DESCRIPTION

Figure 3:
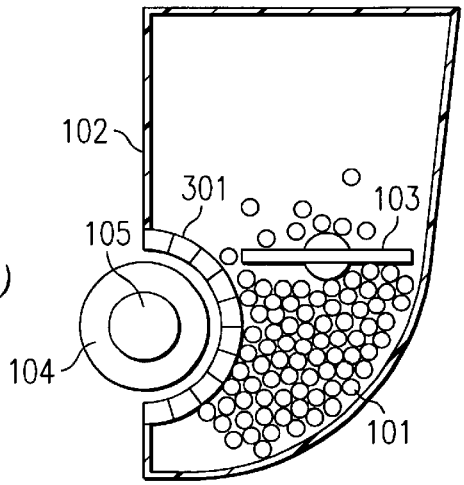
FIG. 3 (PRIOR ART)
FIG. 3is a prior art cross sectional view of a toner hopper with a flexible seal engaging a developer roller.

FIG. 3 is a cross sectional view of an alternative toner supply hopper 102 of the prior art with a flexible seal 301 engaging a developer sleeve 104.

Figure 1:
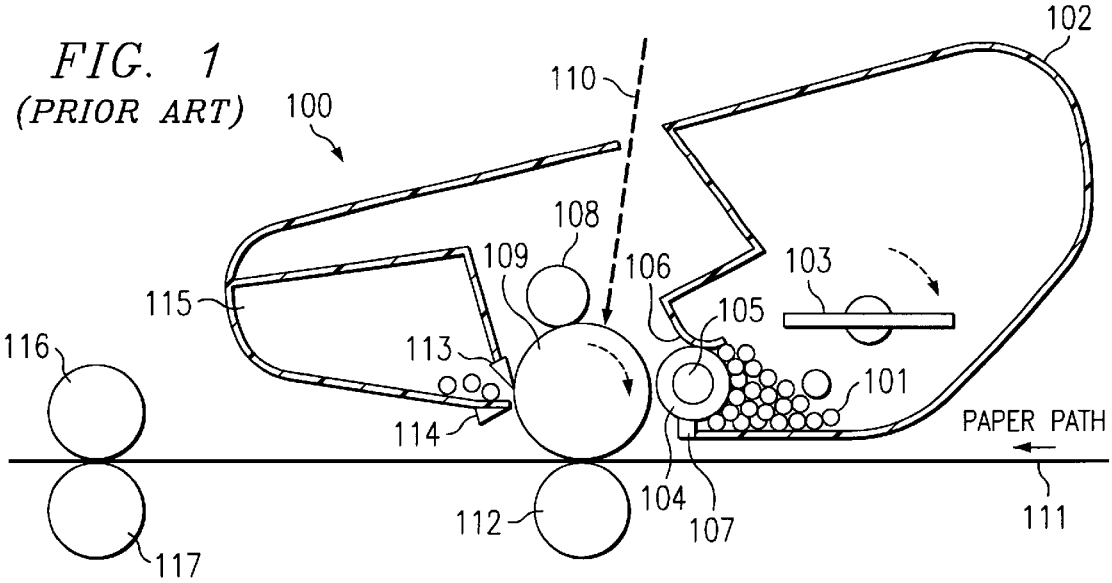
FIG. 1 (PRIOR ART)
FIG. 1 is a cross-section view of a simplified electrophotographic printing device of the prior art.
Figure 2:
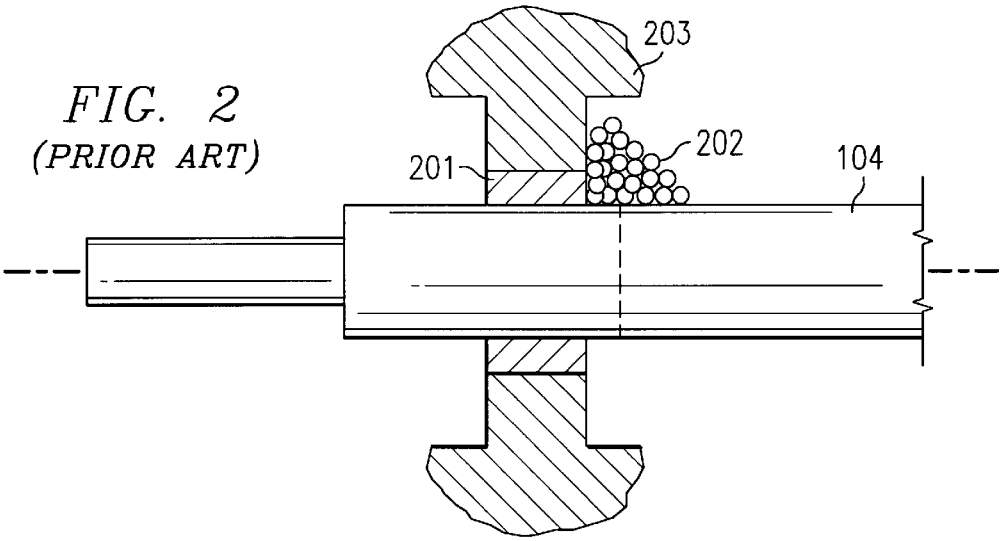
FIG. 2 (PRIOR ART)
FIG. 2 is a prior art developer roller, seal and support.
Figure 4:
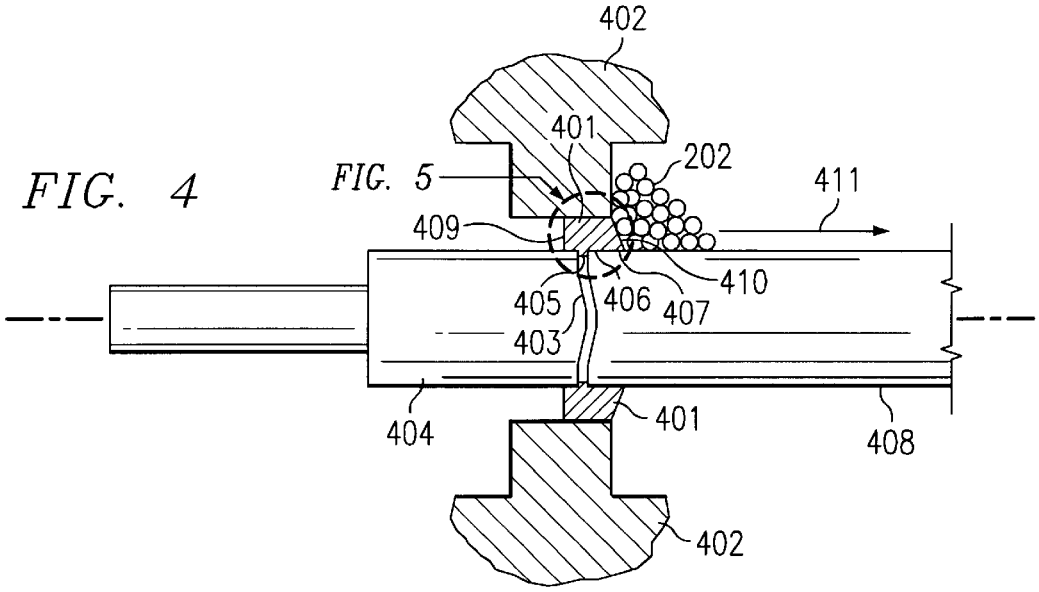
FIG. 4 is a cross sectional view of a developer roller and flexible undulating seal arrangement according to an embodiment of the invention.

FIG. 4 is a cross sectional view of developer roller 404 in which an undulant annular channel 403 has been formed which, as will be seen, is used to cause motion of the scale to move the toner particles away from the ends of the developer roller 404. This undulant annular channel 403 can be raised, or preferably, recessed, with respect to the surface of the developer roller 404. Developer roller 404 can be used with the assembly shown in FIG. 1 or FIG. 3 or with any other assembly as desired. Wrapping around the rear of developer roller 404 is support 402 and attached to support 402 is flexible seal 401. Flexible seal 401 may be attached to support 402 by appropriate bonding methods known to one of ordinary skill in the art. Flexible seal 401 includes a follower 405 which is configured to engage with undulant annular channel 403.

Follower 405 may have a width of 1 to 3 millimeters as appropriate to engage and follow undulant annular channel 403 having a channel width which may be within the range of 2 to 4 millimeters. Rotation of developer roller 404 causes follower 405 to move in a laterally reciprocating motion following the jogs contained in the undulant annular channel 403 causing the flexible seal 401 to undulate over its length. That is, as follower 405 moves in a laterally reciprocating motion, corresponding portions of flexible seal 401 also move in a laterally reciprocating motion such that an undulating motion progresses along the length of the flexible seal 401.

Flexible seal 401 also contains an internal sealing edge 406 and an external sealing edge 407. Both internal sealing edge 406 and external sealing edge 407 are in contact with the outer circumference 408 of developer roller 404. In normal operation toner particles buildup along the circumference of developer roller 404 and along the inside wall 502 of flexible seal 401. Flexible seal 401 has two vertical walls including an outer vertical wall 409 proximate to the end of developer roller 404. An inner vertical wall 410 of flexible seal 401 contacts toner particles of toner buildup 202.

As developer roller 404 rotates, follower 405 engages undulant annular channel 403 and moves in a laterally reciprocating motion such that inner vertical wall 410 of flexible seal 401 pushes toner particles of toner buildup 202 in a direction 411 away from the interface of flexible seal 401 and developer roller 404. Similarly, the laterally reciprocating motion of follower 405 of flexible seal 401 is also present in internal sealing edge 406 and external sealing edge 407. As developer roller 404 rotates, internal sealing edge 406 and external sealing edge 407 also move in a laterally reciprocating motion pushing toner particles toward the center of developer roller 404. As toner particles are moved away from the interface between flexible seal 401 and developer roller 404 toward the center of developer roller 404 they are pushed back into the active imaging region and are spread even by the action of the a doctor blade. One of ordinary skill in the art would appreciate that the interaction between follower 405 and undulant annular channel 403 is but one method to introduce a laterally reciprocating motion of flexible seal 401. Alternatively, external pulsing means such as a lobed cam or other actuation device may be used to institute a laterally reciprocating motion into flexible seal 401. The laterally reciprocating motion of the flexible seal 401 also inhibits packing of toner particles in the junction between flexible seal 401 and developer roller 404.

Figure 5:
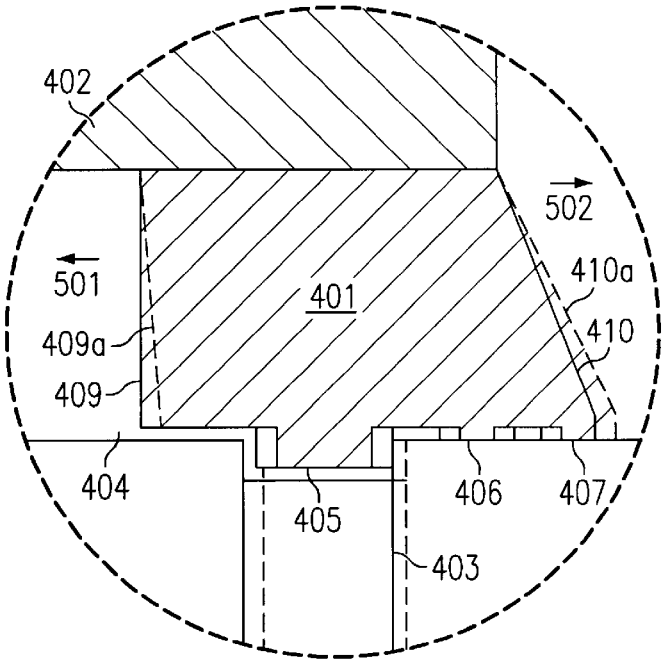
FIG. 5 is an enlarged cross sectional view of the flexible seal in engagement with an undulant annular channel of a developer roller.

FIG. 5 is an enlarged cross sectional view of the junction between flexible seal 401 and developer roller 404 including undulant annular channel 403. Support 402 is attached to flexible seal 401. Flexible seal 401 includes follower 405, internal sealing edge 406 and external sealing edge 407. Two extreme positions, 501 and 502, of flexible seal 401 relative to developer roller 404 are shown in FIG. 5. Extreme position 501 shows undulant annular channel 403 moved to the left, resulting in outer and inner vertical walls 409, 410 being to the left. Extreme position 501 shows undulant annular channel 403 moved to the right, resulting in new locations 409*a* and 410*a* for the outer and inner vertical walls 409, 410. One of ordinary skill in the art would recognize that the configuration of undulant annular channel 403 may be configured to introduce a specific type of laterally reciprocating motion in flexible seal 401 optimized to reduce or eliminate standing toner forming a buildup of toner 202 along flexible seal 401. Parameters to be considered include toner particle size, fluidity of toner, developer roller size and angular speed of rotation, flexibility of material used to manufacture the seal among other things.

Figure 6:
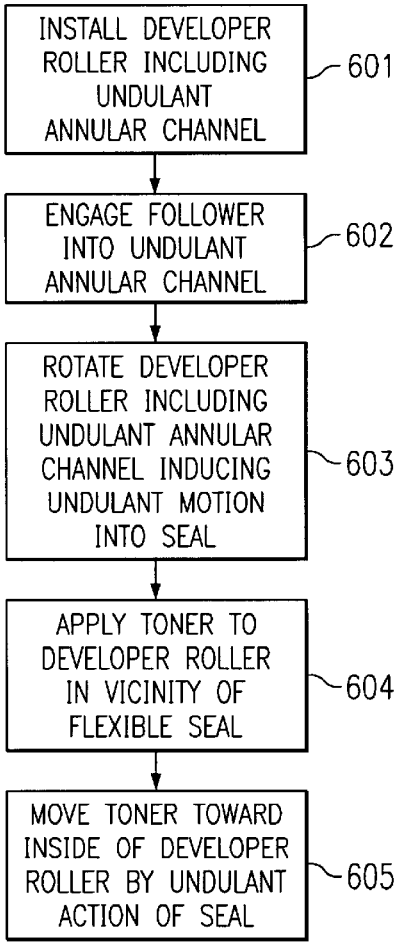
FIG. 6 is a flow diagram of a method of sweeping toner away from a seal end of a developer roller according to the present invention.

FIG. 6 is a flow diagram of one embodiment of a method of the present invention. In step 601, a developer roller 404 including an undulant annular channel 403 is installed into a toner cartridge. As previously described, the purpose of undulant annular channel 403 is to introduce the laterally reciprocating motion into flexible seal 401. Other alternate methods of introducing laterally reciprocating motion into flexible seal 401 are also within the scope of the present invention. In step 602 the flexible seal 401 includes a follower 405 configured to engage with the undulant annular channel 403 of the developer roller 404. Further modifications of flexible seal 401 are possible. For example, internal sealing edge 406 and external sealing edge 407 may also be added to flexible seal 401 and positioned to rest along the top of developer roller 404. In step 603 the developer roller 404 is rotated which includes rotation of the undulant annular channel 403. Follower 405 of flexible seal 401 laterally reciprocates as follower 405 rides within undulant annular channel 403. Preferably, lateral reciprocation is within a range of 0.02 to 1 millimeter each side of center whereby a maximum undulation of flexible seal 401 is between 0.04 and 1 millimeter along its length. One of ordinary skill in the art would appreciate that the function of the undulatant motion is to push or "sweep" toner particles away from the ends of the developer roller 404. In step 604 toner is applied to the developer roller 404 in the vicinity of flexible seal 401. The application of toner is required in the area to support the electrophotographic printing device. At step 605 the laterally reciprocating motion of flexible seal 401 serves to prevent the build-up of pressure of toner at the interface between flexible seal 401 and developer roller 404.

What is claimed is:

1. A sealing mechanism comprising:

a roller having an undulant annular channel; and a flexible seal cooperating with said roller and having a follower engaged with said undulant annular channel.

2. The sealing mechanism of claim 1 wherein rotation of said roller induces a laterally reciprocating motion of said flexible seal with respect to said roller.

3. The sealing mechanism of claim 1 wherein said undulant annular channel is proximate to one end of said roller.

4. The sealing mechanism of claim 1 further comprising a second undulant annular channel located proximate to another end of said roller.

5. The sealing mechanism of claim 1 wherein said flexible seal comprises an elongate member configured to wrap around a circumferential portion of said roller, said roller engaging said undulant annular channel within said circumferential portion of said roller.

6. The sealing mechanism of claim 1 further comprising:

a roller support wherein said flexible seal is attached to said roller support.

7. The sealing mechanism of claim 1 further comprising:

an internal sealing edge configured to engage said roller proximate to said undulant annular channel.

8. The sealing mechanism of claim 1 wherein a laterally reciprocating motion is within a range of 0.02 to 1 millimeter.

9. The sealing mechanism of claim 1 further comprising:

an external sealing ridge edge configured to engage said roller proximate to said undulant annular channel.

10. The sealing mechanism of claim 1 wherein said undulant annular channel is 2 to 4 millimeters wide and said follower is 1 to 3 millimeters wide.

11. A method of reducing material leakage, said method comprising the steps of:

engaging a first follower of a first flexible seal within a first undulant annular channel formed with respect to a roller;

rotating said roller thereby inducing a laterally reciprocating motion in said first flexible seal controlled; at least in part by said first undulant annular channel;

applying material to said roller in a vicinity of said first flexible seal; and whereby said laterally reciprocating motion of said first flexible seal sweeps said material in a direction away from said first undulant annular channel.

12. The method of claim 11 further comprises the step of:

locating said first undulant annular channel proximate to an end of said roller.

13. The method of claim 11 further comprising the step of:

engaging a second follower of a second flexible seal with a second undulant annular channel formed in said roller;

whereby said rotating of said roller induces a laterally reciprocating motion in said second flexible seal; and whereby said laterally reciprocating motion of said second flexible seal sweeps said material in a direction toward said first flexible seal.

14. The method of claim 11 further comprising a step of:

joining said first flexible seal to a roller support.

15. The method of claim 11 wherein said material is toner and wherein said method further comprises the step of:

capturing residual toner in an area located between an exterior face of said first flexible seal and said first follower.

16. The method of claim 11 wherein said step of engaging said follower induces a laterally reciprocating motion in said first flexible seal over a range of 0.02 to 1 millimeter.

17. The method of claim 11 further comprising a the steps of:

configuring said first undulant annular channel to have a width of 2 to 4 millimeters; and configuring said first follower to have a width of 1 to 3 millimeters.

18. A toner cartridge comprising:

a housing;

a development unit including a toner supply hopper and a roller having a cylindrical exterior surface with a pair of undulant annular channels formed in said exterior surface at opposite ends of said roller;

a cleaning unit including a waste hopper, a wiper blade, a cleaning blade and a blow-out blade;

a primary charge roller;

a transfer roller;

an Organic Photo Conductor; and a pair of flexible seals each having a follower engaging a respective one of said pair of said undulant annular channels.

19. A roller for use in a printing system, said roller including means for engaging with an engaged seal such that the rotation of said roller around a lateral axis of said roller causes said engaged seal to laterally reciprocate so as to prevent toner from accumulating at least at one end of said roller.

20. The roller of claim 19 wherein said engaging means include at least one undulant annular channel.

* * * * *

UNITED STATES PATENT AND TRADEMARK OFFICE

CERTIFICATE OF CORRECTION

PATENT NO. : 6,697,585 B2
DATED : February 24, 2004
INVENTOR(S) : Dougherty et al.

It is certified that error appears in the above-identified patent and that said Letters Patent is hereby corrected as shown below:

Column 2,
Line 35, delete “is”.
Line 43, delete “are”.
Line 55, delete “is”.

Column 3,
Line 1, delete “the”.
Line 44, delete “a the” and insert therefor -- the --.

Column 4,
Line 57, delete “the a” and insert therefor -- a --.

Column 6,
Line 21, delete “ridge”.
Line 33, delete “controlled;” and insert therefor -- controlled --.
Line 64, delete “a”.

Signed and Sealed this

Twenty-fifth Day of January, 2005

JON W. DUDAS
*Director of the United States Patent and Trademark Office*